US009310162B2

(12) United States Patent
Vertreese

(10) Patent No.: US 9,310,162 B2
(45) Date of Patent: Apr. 12, 2016

(54) UNIVERSAL GUN HOLSTER

(71) Applicant: Ariel V. Vertreese, Lee's Summit, MO (US)

(72) Inventor: Ariel V. Vertreese, Lee's Summit, MO (US)

( * ) Notice: Subject to any disclaimer, the term of this patent is extended or adjusted under 35 U.S.C. 154(b) by 102 days.

(21) Appl. No.: 14/325,030

(22) Filed: Jul. 7, 2014

(65) Prior Publication Data

US 2016/0003578 A1 Jan. 7, 2016

(51) Int. Cl.
*F41C 33/02* (2006.01)
*F41C 33/04* (2006.01)

(52) U.S. Cl.
CPC ..... *F41C 33/0209* (2013.01); *F41C 33/043* (2013.01); *F41C 33/048* (2013.01); *A45F 2200/0591* (2013.01); *F41C 33/02* (2013.01); *F41C 33/0236* (2013.01); *F41C 33/041* (2013.01); *Y10S 224/911* (2013.01)

(58) Field of Classification Search
CPC .... F41C 33/02; F41C 33/0236; F41C 33/041; A45F 2200/0591; Y10S 224/911
USPC ..... 224/192, 193, 58, 198, 238, 243, 244, 224/911
See application file for complete search history.

(56) References Cited

U.S. PATENT DOCUMENTS

| | | | | |
|---|---|---|---|---|
| 3,003,670 | A | 10/1961 | Stella | |
| 3,707,250 | A * | 12/1972 | Esposito | F41C 33/0227 224/243 |
| 4,577,787 | A | 3/1986 | Hersey | |
| 4,846,383 | A | 7/1989 | Gallagher | |
| D331,497 | S | 12/1992 | Dixon | |
| 6,264,079 | B1 * | 7/2001 | Skaggs | F41C 33/0236 224/193 |
| 6,561,402 | B2 | 5/2003 | Holland et al. | |
| 6,695,186 | B2 | 2/2004 | Madarang | |
| 7,204,395 | B2 | 4/2007 | Gallagher | |
| 7,258,259 | B1 | 8/2007 | Owens | |
| 7,314,152 | B1 | 1/2008 | Garrett | |
| D715,538 | S * | 10/2014 | Vertreese | D3/222 |
| 9,144,292 | B2 * | 9/2015 | Prestwich | A45F 5/00 |
| 2014/0048572 | A1 | 2/2014 | Yeates | |

* cited by examiner

*Primary Examiner* — Justin Larson
(74) *Attorney, Agent, or Firm* — Erickson Kernell Derusseau & Kleypas, LLC

(57) ABSTRACT

A universal holster for handguns. The holster includes front and back generally parabolic-shaped panels that are stitched together along a portion of their lateral edges. A lower portion of the panels is bifurcated into a pair of legs and enables independent flexure thereof. A pair of laterally spaced clips is provided on the back panel for coupling to a user's belt, waistband or other article. An upper tab extends from an upper edge of each panel to obstruct contact with a gun disposed in the holster. A microfiber lining is provided to aid securing and protecting the gun in the holster.

20 Claims, 6 Drawing Sheets

UNIVERSAL GUN HOLSTER

BACKGROUND

Holsters are well-known articles for carrying and/or concealing guns and other weapons or items on a user's body or within reach of the user, such as within a pocket, handbag, or other personal item. Many holsters are designed for wearing by a user on a belt or waistband of the user's pants, while others include harnesses or straps for wearing around the torso, arms, legs, ankles or the like. Gun holsters are typically employed for carrying handguns, i.e. smaller, handheld guns that can be fired single-handedly. These holsters are often designed or formed to fit a particular style or model of gun so as to provide a secure and stable fit between the gun and holster. Such holsters may also be specifically designed for wearing on a particular side of the user to accommodate either a left-handed or right-handed user.

Due to the great number of types and styles of guns available and the need to accommodate both right- and left-handed users, manufacturers must produce a large variety of holsters to fit the broad spectrum of customer needs. And users must purchase specific, and likely multiple, holsters to accommodate each of the guns they wish to carry and each method of carrying they wish to employ, e.g. right-handed, left-handed, concealed, etc.

A variety of attempts have been made to overcome these deficiencies. For example, U.S. Pat. No. 3,003,670 to Stella discloses a leather gun holster with a simple generally tubular pocket structure that can be worn on the belt of the user. The pocket has a uniform design that can receive a handgun in either a right- or a left-handed orientation. The pocket is not designed for a specific gun but is limited to a relatively narrow selection of guns with dimensions that fit within the narrow pocket.

U.S. Pat. No. 4,577,787 to Hersey describes a holster that includes loops or apertures through which a user's belt is inserted for wearing on the inside or outside of the belt. The holster can be inverted to switch between a forward-tilted and a cross-draw orientation and can be reversed laterally to switch between a right-handed orientation and a left-handed orientation. The design of the holster requires the holster to be sized according to the particular gun to be carried.

U.S. Pat. No. 7,258,259 to Owens discloses a molded semi-universal holster that is useable with a variety of sizes, styles, and calibers of gun but is not ambidextrous and is limited to a particular model line of gun, e.g. the holster is limited to, for example, a model line of semi-automatic guns or revolvers that are of generally the same size and shape. The holster includes a series of adjustment springs and molded stops that are useable to customize the tension between a gun receptacle and a gun disposed therein.

What is needed in the art is a holster that that is configured to universally receive the vast majority of available handguns and to securely retain a selected gun therein. Such a holster that is also wearable in a right- or left-handed orientation and in a concealed or open-carry fashion is also desirable.

SUMMARY

Embodiments of the invention are defined by the claims below, not this summary. A high-level overview of various aspects of the invention is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes, among other things, a gun holster that is useable with a large variety of handguns and that can be worn in a right- or left-handed orientation and in a concealed or open-carry fashion.

The gun holster is constructed from a pair of like panels that are coupled along opposite lateral edges. The panels include a centrally located upper tab that covers a safety switch on many gun styles and that obstructs contact between the user's body and a butt end of the gun. A lower portion of each of the panels is bifurcated; the bifurcation enables receipt of a large variety of gun barrel sizes therethrough and provides flexibility to the lower portion of the holster. The flexibility enhances user comfort by enabling conformance of the holster and gun position to the user's body position, e.g. when sitting.

Opposing faces of the panels include a material layer, such as a microfiber textile, that enhances friction between the panel and the gun for retention thereof. The material layer may also resist or prevent corrosion, tarnishing, rubbing, or other damage to the gun surfaces by wicking away any fluids. One or more ribs may also be disposed within the panels so as to be palpable through or on the opposing faces. The ribs provide additional frictional and/or mechanical engagement between the holster and the gun for retention thereof within the holster.

A pair of laterally-spaced clips is provided on a backside of the holster for coupling to a user's belt, waistband, or other article. The lateral spacing of the clips aids to conform the holster to the arcuate path of the user's waist or body. Such conformance may also increase tension on one or both of the panels to further increase the frictional engagement between the panel and the gun.

Each of the clips includes a U-shaped form having a pair of legs. Each leg includes an undulation or bend that is slightly offset from and in opposition to an undulation or bend in the opposite leg. The offset of the undulations is configured to provide contact surfaces therebetween that are aligned at an angle with respect to the legs of the clip. The contact surfaces thus provide strong resistance to movement of a user's belt, clothing, or other articles therebetween.

DESCRIPTION OF THE DRAWINGS

Illustrative embodiments of the invention are described in detail below with reference to the attached drawing figures, and wherein.

DETAILED DESCRIPTION

Figure 1:
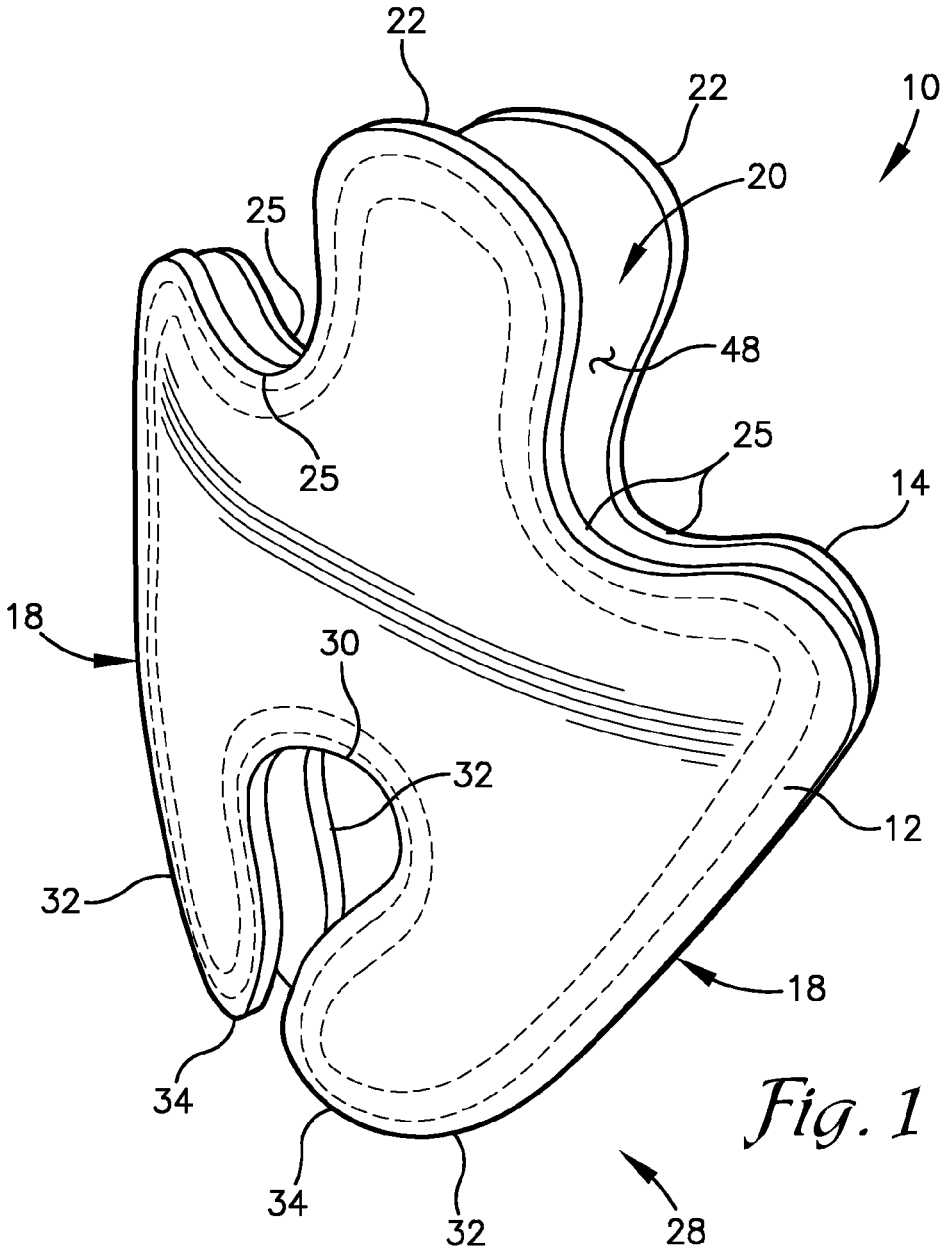
FIG. 1 is a perspective view of a universal gun holster depicted in accordance with an embodiment of the invention.
Figure 2:
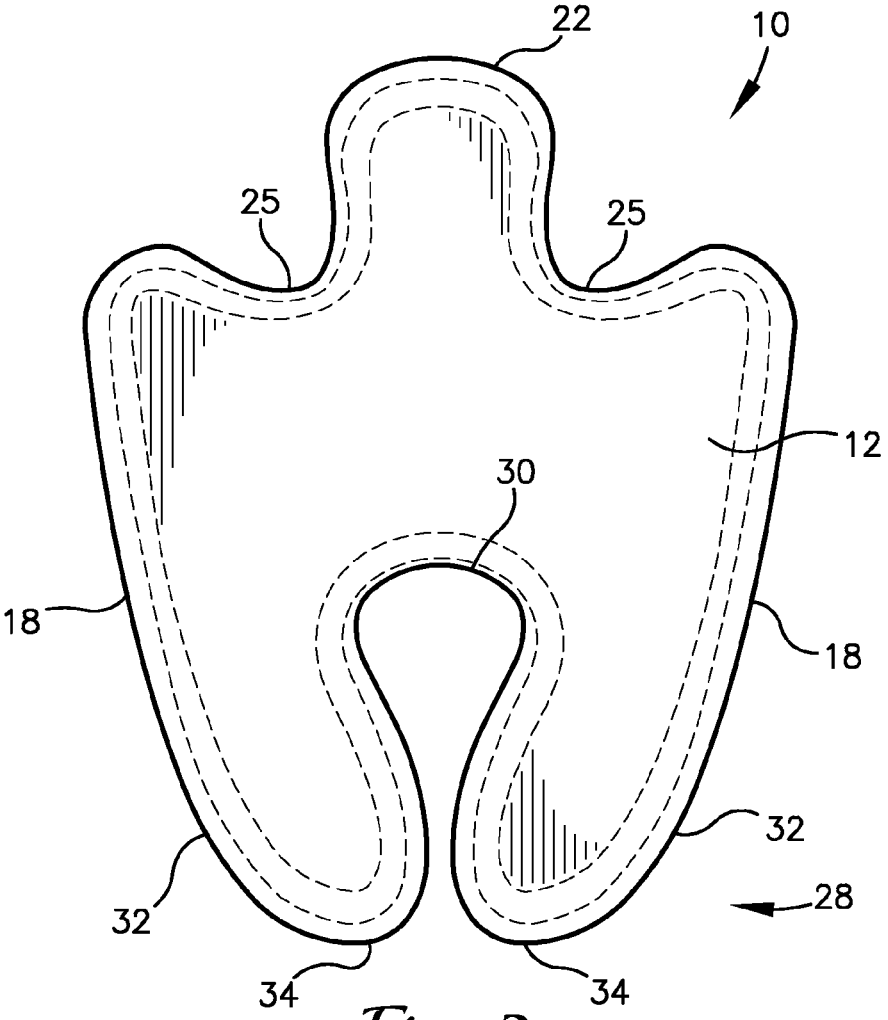
FIG. 2 is front side elevational view of the gun holster of FIG. 1.
Figure 3:
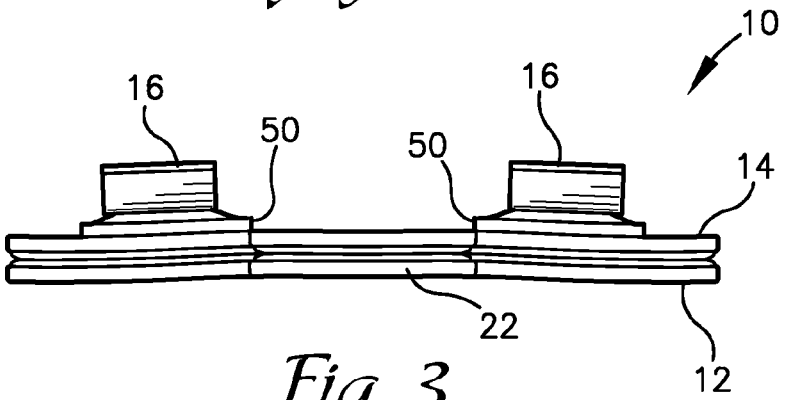
FIG. 3 is a top end elevational view of the gun holster of FIG. 1.

The subject matter of select embodiments of the invention is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" as used herein denote deviations from the exact value by +/−10%, preferably by +/−5% and/or deviations in the form of changes that are insignificant to the function.

With reference now to FIGS. 1-10, a universal gun holster 10 is described in accordance with an embodiment of the invention. The holster 10 is described herein with respect to use thereof with handguns, but such is not intended to so limit applications of embodiments of the invention. For example, the holster 10 might be used to receive other forms or styles of guns, like rifles, or shotguns among others, or the holster 10 might be employed to carry weapons such as knives or tools such as power drills and other hand tools, among a variety of other items. As used herein, the term handgun is intended to denote available guns and firearms generally configured for hand-held operation/firing in one or both hands. Such handguns include revolvers, pistols, and the like and can be configured for semi-automatic, automatic, single-action, or double-action style operation, among other available types or styles of guns and modes of operation.

The holster 10 is also described herein as being worn by a user on a belt or waistband of the user's clothing, however the holster 10 can be coupled to any of a variety of personal items, such as handbags, pockets, purses, or the like for carrying by the user. Or the holster 10 can be coupled or attached to another object for retaining or carrying a desired item. For example, the holster 10 might be attached to an all-terrain vehicle (ATV) and used to securely carry a handgun thereon.

The holster 10 comprises a front panel 12 and a back panel 14 and a pair of laterally-spaced clips 16. The front and back panels 12, 14 comprise substantially planar panels that are coupled together along or adjacent to at least a portion of their lateral edges 18, such as by stitching, gluing, welding, or other joining method, to form a receptacle space 20 therebetween. In one embodiment, the front and back panels 12, 14 are formed from a single section of material that is folded in half to form the front and back panels 12, 14. The front and back panels 12, 14 are generally mirror images of one another, however such is not required. The panels 12, 14 are somewhat wedge-shaped or parabolic-shaped such that an upper end has a greater width than a lower end.

The front and back panels 12, 14 are sized to form a receptacle space 20 of sufficient dimensions to receive a large majority of available guns 24. In one embodiment, the panels 12, 14 have a maximum width of between approximately 120 mm and 160 mm, or more preferably about 130 mm, and an overall height of between approximately 145 mm and about 190 mm, or more preferably about 160 mm. In another embodiment, the holster 10 is sized to accept the largest 10% of available guns 24 and thus the panels 12, 14 have a width of approximately 150 mm and a height of approximately 180 mm.

Figure 8:
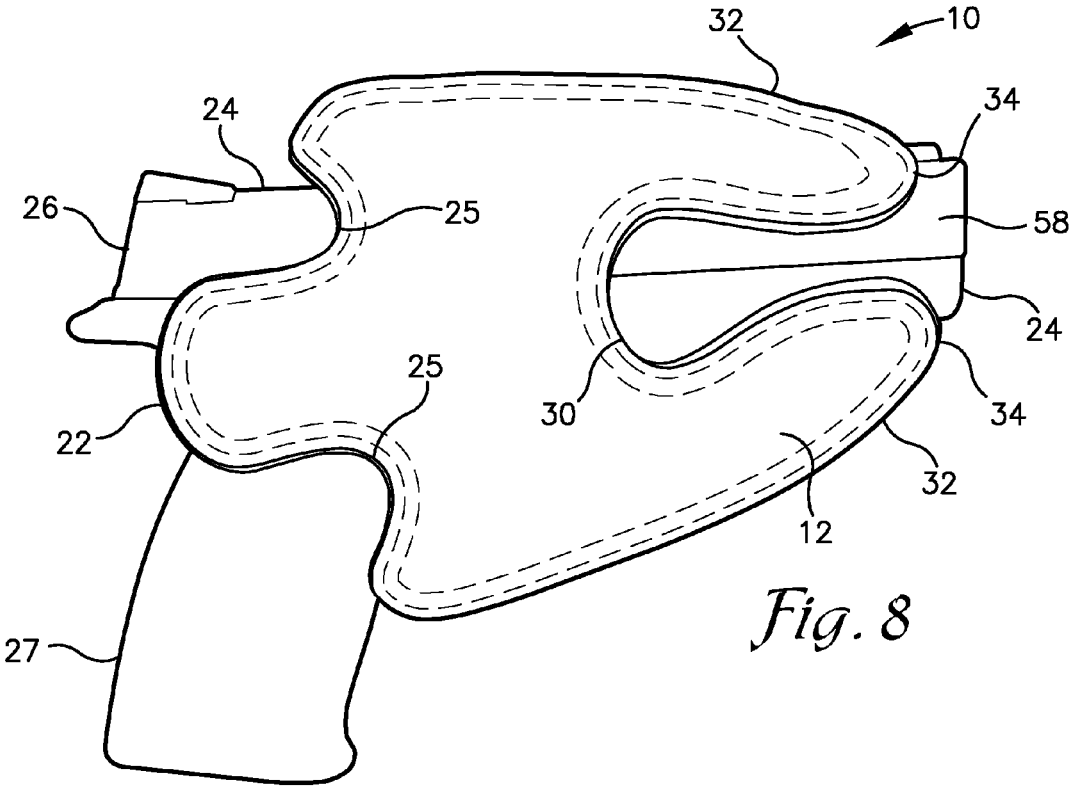
FIG. 8 is front side view of the gun holster of FIG. 1 with a handgun disposed therein in accordance with an embodiment of the invention.

Each of the panels 12, 14 includes an upper tab 22 that is centrally located along and extending from an upper end of the respective panel 12, 14 in a direction substantially within the plane of the respective panel 12, 14. The upper tab 22 has sufficient width and length to at least partially cover a portion of a gun 24 disposed within the receptacle space 20, as shown in FIG. 8. In some embodiments, the gun 24 is a semi-automatic pistol that includes a safety lever or switch located along the side of the gun 24 near a butt 26 of the gun 24; the upper tab 22 is preferably sized and configured to substantially cover or obstruct contact with the safety lever by the user while the gun 24 is disposed in the holster 10. The upper tab 22 may also prevent a user's finger from engaging a trigger of the gun 24 until after the gun 24 has been substantially withdrawn or cleared from the holster 10.

The upper tab 22 may be flanked on each side by a depression 25. The depressions 25 extend into the upper edge of the panels 12, 14 and toward the lower end thereof. The depressions 25 provide additional clearance for a handle 27 of the gun 24 and/or for a user's hand or fingers when inserting/withdrawing the gun 24 from the holster 10. The depressions 25 can have a shape or form that mimics an angle of the handle 27 when the gun 24 is inserted into the holster 10.

Figure 9:
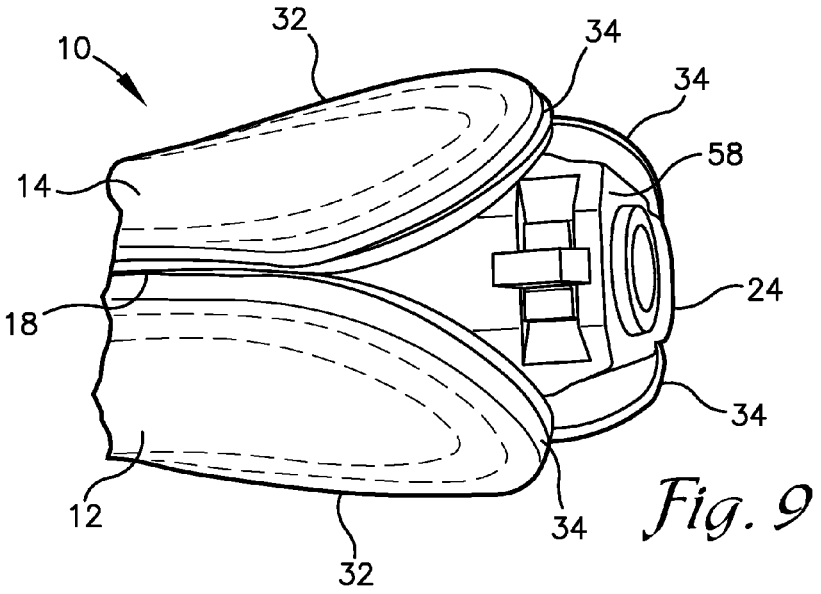
FIG. 9 is perspective view of the bottom end of the gun holster of FIG. 8.

A lower portion 28 of each of the panels 12, 14 includes a central notch 30 or cutout that bifurcates the lower portion 28 into a pair of legs 32. The leg 32 on each opposing lateral side of the holster 10 is thus independently flexible or moveable relative to the other leg 32. The legs 32 of each of the panels 12, 14 on the same lateral side of the holster 10 are at least partially coupled together via the stitching or other coupling between the front and back panels 12, 14. However, the stitching or other coupling between the front and back panels 12, 14 terminates short of the distal ends 34 of the legs 32, such that the distal ends 34 are each independently flexible or moveable, as shown in FIG. 9.

Figure 7:
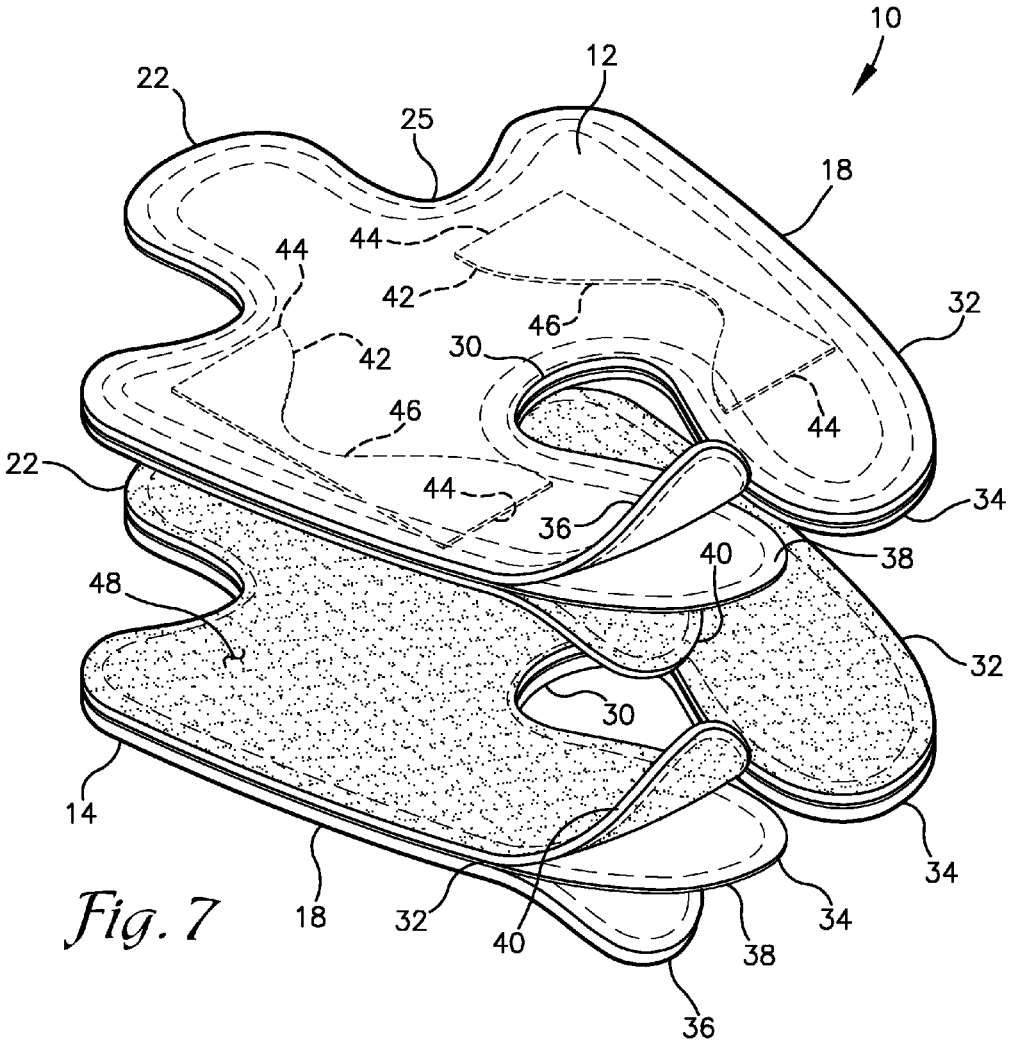
FIG. 7 is an illustrative view of one panel of gun holster showing material layers making up the panel in accordance with an embodiment of the invention.

As depicted in FIG. 7, the panels 12, 14 include a plurality of layers of material. Both the front and back panels 12, 14 include an outer layer 36, a backing layer 38, and a lining 40. More or fewer materials and layers thereof can be employed in embodiments of the invention without departing from the scope described herein. For example, in one embodiment, the panels 12, 14 are constructed from a single layer of material, such as a leather, synthetic material, or the like.

The outer layer 36 is preferably constructed from a material that is durable, e.g. resists degradation through normal wear-and-tear and use of the holster 10, and that provides a desired aesthetic appearance to the exterior of the holster 10. The outer layer 36 may be leather, synthetic leather, nylon, plastic, or other natural or synthetic material and may be embossed, dyed, colored, imprinted, or otherwise imparted with one or more colorations or surface ornamentations.

The backing layer 38 comprises a stiffening or reinforcing material such as a resilient and pliable plastic sheet that is coupled to the outer layer 36 via one or more of stitching, gluing, or the like. The backing layer 38 provides additional stiffness to the panels 12, 14. The lining 40 is similarly coupled to the backing layer 38 via stitching and/or one or more glues, adhesives, or the like. The lining 40 is preferably a synthetic microfiber material, but may comprise other available materials like cotton, felt, wool, leather, nylon, among others. The lining 40 increases the frictional engagement between the gun 24 and the holster 10 and may prevent or resist damage to the gun 24 while within the holster 10 that may result from relative movement or rubbing between the gun 24 and the lining 40. The lining 40 also preferably has moisture wicking properties that aid movement of any fluids away from the gun 24 to thereby prevent or resist tarnishing or other corrosion of the gun's metals.

The front panel 12 further includes a rib 42 disposed between the backing 38 and the lining 40 near the base of each leg 32 so as to be palpable through the lining 40. Each of the ribs 42 extends from near the base of the respective leg 32 toward the upper end of the front panel 12 and includes a laterally extending portion 44 adjacent each end thereof. As depicted in FIG. 7, the ribs 42 comprise generally rectangular sections of material having one curvilinear side 46 that is depressed into the rectangular form near a generally central location along the side to form the laterally extending portions 44 on either side thereof. In one embodiment, the curvilinear side 46 generally mimics the shape of a trigger guard on the gun 24. One of skill in the art will understand a variety of other configurations of the ribs 42 that can be employed to provide the same or similar function as described herein. For example, in another embodiment, a plurality of laterally extending ribs might be disposed between the backing layer 38 and the lining 40, e.g. one shorter rib extending at least partially across the base of each leg 32 and one longer rib extending across the upper end of the panel 12. All such configurations and variations thereof are to be understood as falling with the scope of embodiments of the invention described herein. In another embodiment, the ribs 42 are alternatively or additionally included in the back panel 14.

The ribs 42 can be constructed from any available materials including leathers, synthetic materials, plastics, foams, rubbers, or the like that have a thickness sufficient to be palpable through the lining 40 or to form a raised feature on an interior surface 48 of the front panel 12. In one embodiment, the ribs 42 are produced from scrap or cutaway materials left over from production of the outer layer 36.

Figure 4:
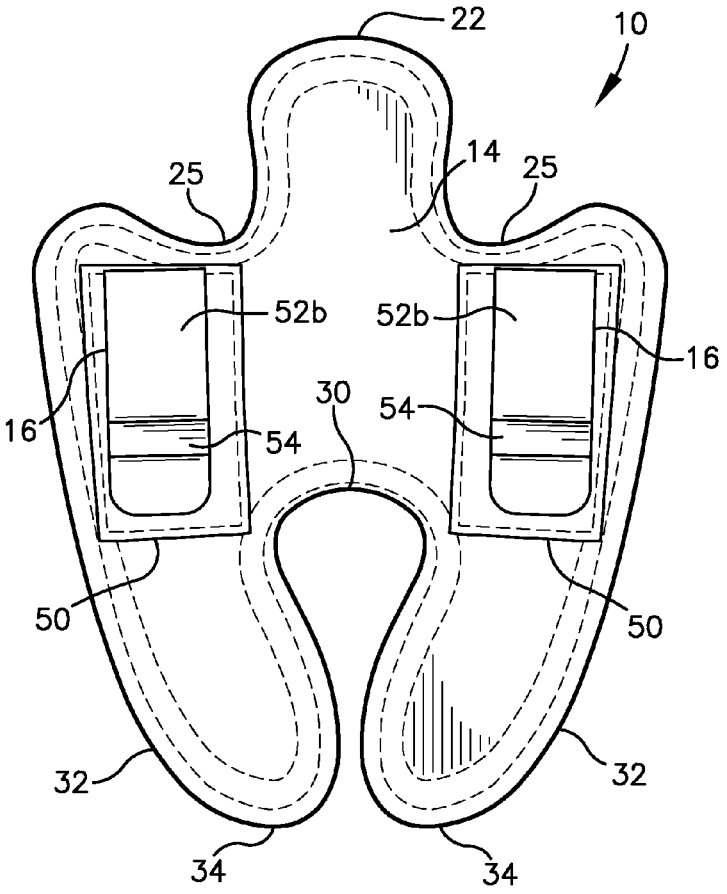
FIG. 4 is a back side elevational view of the gun holster of FIG. 1.
Figure 5:
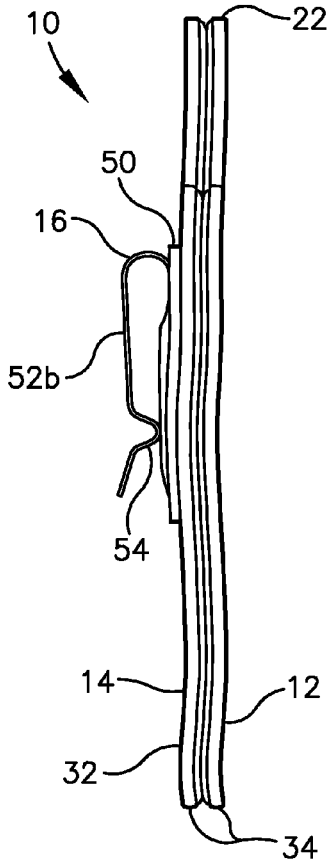
FIG. 5 is a side elevational view of the gun holster of FIG. 1.
Figure 6:
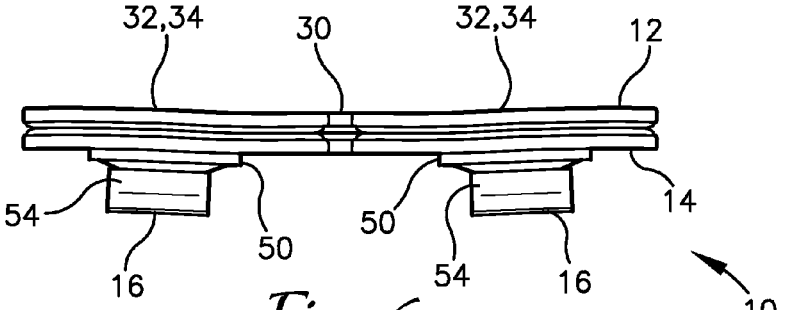
FIG. 6 is a bottom end elevational view of the gun holster of FIG. 1.

With reference to FIGS. 4-6, the back panel 14 includes the clips 16 disposed on the outer layer 36 thereof. The clips 16 are spaced apart laterally toward the lateral edges 18 of the back panel 14 and are substantially aligned relative to the longitudinal dimension of the back panel 14. Mounting panels 50 are provided for coupling the clips 16 with the back panel 14. The mounting panels 50 comprise sections of material coupled to the back panel 14 by stitching, adhesives, or other methods. The mounting panels 50 may include one or more apertures (not shown) through which a leg 52 of the clip 16 can be inserted to engage a pocket formed between the mounting panel 50 and the back panel 14. In another embodiment, the clips 16 are coupled or attached directly to the back panel 14, such as by stitching, rivets, welding, glues, adhesives, or the like. In another embodiment, the back panel 14 includes the one or more apertures through which the leg 52 of the clip 16 can be inserted.

Figure 10:
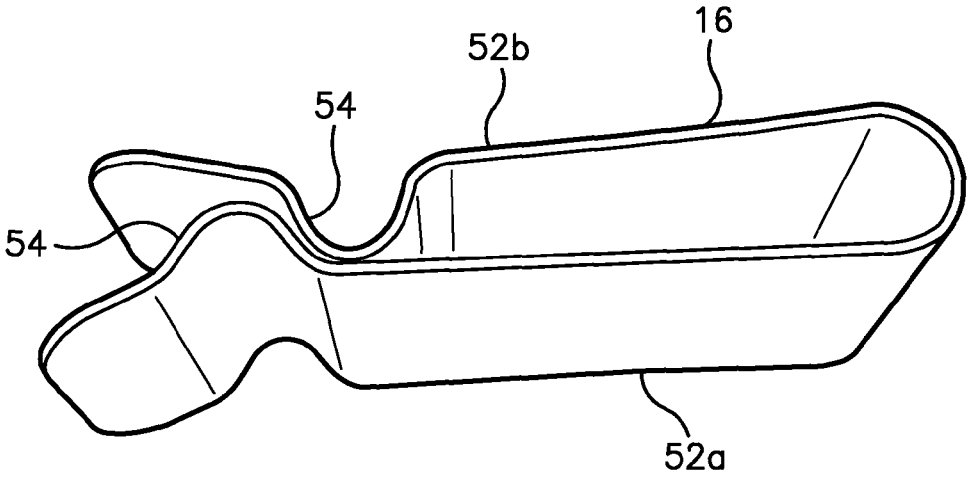
FIG. 10 is a perspective view of a belt clip depicted in accordance with an embodiment of the invention.

With reference to FIG. 10, the clips 16 include a U-shaped form having two opposing legs or arms 52—an internal arm 52*a* disposed within the pocket formed by the mounting panel 50 and an external arm 52*b*. Although a preferred configuration of the clips 16 is described herein, such is not intended to limit the scope of embodiments of the invention to any particular clip design. Each of the arms 52 of the clip 16 includes an undulation 54, bend or other raised feature located along the length of the respective arm 52 and near the distal end thereof. The undulations 54 extend from the respective arms 52 toward the opposite arm 52. The undulations 54 are at least partially offset such that they contact one another along sides thereof, e.g. not at their peaks, or one or both of the undulations 54 contacts the opposing arm 52 adjacent to the opposing undulation 54. As such, when an article, such as a waistband of a user's pants is inserted between the arms 52, a contact surface 56 formed between the article and the undulations 54 is aligned at an angle 8 to the length of the arms 52, i.e. not parallel to the arms 52. In one embodiment, the angle 8 is orthogonal to or nearly orthogonal to the length of the arms 52, or 8 is between about 30° and about 80°, or between about 40° and about 60°. The resistance to withdrawal of the article from between the arms 52 is thus much greater than what would be encountered if the article was captured between the peaks of the undulations 54, e.g. between surfaces parallel to the length of the arms 52. In one embodiment, the undulation 54 on the internal arm 52*a* engages an aperture or other feature in the mounting pocket 50 to aid retention of the clip 16 within the pocket formed by the mounting panel 50.

With continued reference to FIGS. 1-10, use and operation of the holster 10 is described in accordance with an embodiment of the invention. The holster 10 may be coupled to a user's belt, waistband, or other article prior to or after insertion of the gun 24 therein. Coupling of the holster 10 to an article is completed by simply inserting at least a portion of the article between the inner and outer arms 52*a*, 52*b* of each of the clips. When worn on the belt or waistband, the holster 10 can be placed at any location around the user's torso and can be located outside the belt/waistband, between the belt and waistband, or inside the waistband, e.g. between the waistband and the user's body. The holster 10 is thus useable for left- or right-handed operation and in concealed or open-carry orientations.

To insert the gun 24 into the receptacle space 20 of the holster 10, central portions of the front and back panels 12, 14 are separated to open up the receptacle space 20. Separation of the front and back panels 12, 14 at least partially draws the lateral edges 18 toward one another and at least partially bows one or both of the front and back panels 12, 14.

A barrel portion 58 of the gun 24 is inserted between the front and back panels 12, 14 and may protrude from the lower portion 28 of the holster 10. The gun 24 is moved into the receptacle space 20 until the handle 27 of the gun 24 abuts a top edge of the front and back panels 12, 14 or until the gun 24 is no longer easily moveable into/through the receptacle space 20. In one embodiment, the gun 24 is moved into the receptacle space 20 until a trigger guard of the gun 24 abuts the curvilinear side 46 of the rib 42 in the front panel 12. The uniform shape of the front and back panels 12, 14 is configured to accept the gun 24 in both a right- or left-handed orientation as desired. Additionally, the partial wedge or parabolic shape of the holster 10 places the gun 24 in a slightly angled orientation when inserted therein to provide a comfortable position from which to grasp and withdraw the gun 24.

In this holstered position, as shown in FIG. 8, the upper tabs 22 overlie at least a portion of the gun 24 near the butt 26 thereof. The upper tabs 22 may thus obstruct inadvertent contact or operation of a safety lever or switch on the gun 24 in embodiments in which the gun 24 includes such a safety lever or switch. The upper tab 22 of the back panel 14 may also aid to prevent contact between the butt 26 of the gun 24 and the user's body or clothing so as to avoid or prevent irritation of the user's body and/or transfer of sweat, oils, or other substances to the gun 24 which may cause corrosion thereof.

The configuration of the lower portion 28 of the holster 10 aids to accept barrels 58 of a large variety of sizes and lengths. The bifurcation of the lower portion 28 into the legs 32 enables the lower portion 28 to flex and conform to barrels 58 of various cross-sectional sizes and configurations more easily than that of a continuous panel and without losing tension between the panels 12, 14 and the gun 25. Longer barrels 58 can extend through the lower end of the holster 10 while shorter barrels 58 can be sufficiently maintained within the receptacle space 20. The distal ends 34 of the legs 32 are also free to flex independently and thus further enable conformance to wide variety of barrel configurations. The generally wedge- or parabolic-shaped form of the panels 12, 14 may provide additional room within the receptacle space 20 for receiving guns 24 with accessories, such as rail-mounted targeting devices, flashlights, or the like coupled thereto.

The bifurcated lower portion 28 also aids conformance of the holster 10 and gun position to the user's body position. For example, when a user, wearing the holster 10 on his or her hip moves from a standing position to a kneeling or sitting position the holster 10 and the gun 24 therein may be forced against the user's leg and/or hip due to the location of the holster 10 on the use's body and the natural movements of thereof. The bifurcation enables the legs 32 to flex independently and thus the gun 24 within the holster 10 is enabled to at least partially move to follow the user's body position while still being sufficiently and substantially maintained within the holster 10. The gun 24 may, for example, slightly twist or pivot within the holster 10 via flexure of one or more of the legs 32 and/or distal ends 34 thereof and/or the panels 12, 14. The resiliency of the panels 12, 14 and the frictional engagement with the gun 24 continue to operate to maintain the gun 24 in the holster 10 and to return the gun 24 to substantially the original position when the user again assumes the standing position.

The gun 24 is maintained in the holstered position by one or more of a plurality of mechanisms including: compression forces between the panels 12, 14 and the gun 24; frictional engagement between the lining 40 and the gun 24; and frictional and/or mechanical engagement between the ribs 42 and the gun 24. The stiffness of the panels 12, 14 provided by the backing layer 38 and/or one or more other layers biases the panels 12, 14 toward a flat or planar orientation. This bias urges the panels against the sides of the gun 24 and may create a tension force in the panels 12, 14 and/or a compression force on the gun 24 to aid holding the gun 24 within the receptacle space 20 and to resist movement of the gun 24 within the receptacle space 20 relative to the holster 10. Additionally, when the holster 10 is coupled outside a user's belt or waistband, the laterally spaced clips 16 are urged toward the user's body and to follow the curvature of the user's body; the back panel 14 is thus also urged to follow the curvature. This applies additional tension across the front panel 12 and increases the compression forces between the panels 12, 14 and the gun 24. When worn interior to the user's belt/waistband, contact between the user's body and the front panel 12 may apply additional forces on the front panel 12 and thus on the gun 24. These compression and tension forces between the panels 12, 14 and the gun 24 also increase the frictional forces between the lining 40 and the gun 24.

The ribs 42 provide additional resistance to withdrawal of the gun 24 from the receptacle space 20 and to movement of the gun 24 relative to the holster 10 while in the holstered position. When pressed against surfaces of the gun 24 by the tension/compression forces between the panels 12, 14 and the gun 24, the ribs 42 provide regions of increased contact forces between the front panel 12 and the gun 24 and thus increased frictional engagement therebetween. The ribs 42 may also engage surface features of the gun 24 to produce at least a partial mechanical engagement therewith that further resists withdrawal and/or movement of the gun 24 relative to the holster 10.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of all structures and arrangements, designs, or variations thereof that are within the scope of this disclosure, that are readily identifiable by one of skill in the art, and that can perform the particular function in a similar way. Certain features and sub-combinations are of utility and may be employed without reference to other features and sub-combinations and are contemplated within the scope of the claims.

What is claimed is:

1. A universal holster for handguns comprising:

a front panel and a back panel that each include a first and a second lateral side, the front and back panels being coupled together along at least a portion of the first and second lateral side to form a receptacle space between the front and back panels in which a gun is receivable, each of the panels having a lower end that is bifurcated to form a first leg and a second leg, the first legs of the front and back panels being at least partially coupled together along the first lateral side, and the second legs being at least partially coupled together along the second lateral side; and a clip coupled to the back panel and configured to couple the holster to an article.

2. The holster of claim 1, wherein the first legs of the front and back panels are flexible independent of the second legs of the front and back panels.

3. The holster of claim 2, wherein independent flexure of the first legs and second legs enables one or more of twisting and pivotal movement of a gun received in the receptacle space to allow at least partial conformance of the holster to a user's body in association with a plurality of positions of the user's body.

4. The holster of claim 1, wherein a distal end of the first leg of the front panel is flexible independent from a distal end of the first leg of the back panel.

5. The holster of claim 1, further comprising a second clip coupled to the back panel and that is laterally spaced apart from the clip, the second clip being configured to couple the holster to the article.

6. The holster of claim 5, wherein coupling of the clip and the second clip to the article at least partially conforms the holster to a curvature of the article and increases a tension force applied to one or both of the front and back panels.

7. The holster of claim 1, wherein one or both of the front panel and the back panel includes an upper tab extending from an upper end thereof, the upper tab at least partially obstructing contact with a portion of a butt end of a gun that is received in the receptacle space.

8. The holster of claim 1, wherein one or both of the front panel and the back panel includes a depression in an upper edge thereof that one or more of aids guiding a gun being disposed into the holster via contact with a handle of the gun and aids a user in accessing the handle of a gun that is disposed in the holster.

9. The holster of claim 1, wherein one or both of the front panel and the back panel are comprised of a plurality of layers of material that include one or more of an outer layer, a resilient backing layer, and a liner.

10. The holster of claim 9, wherein the liner comprises a microfiber cloth.

11. The holster of claim 1, wherein one or both of the front panel and the back panel includes one or more ribs that form one or more raised features on a surface of the respective panel that is interior to the holster, the raised features providing one or more of frictional and mechanical engagement between the holster and a gun disposed therein.

12. The holster of claim 11, wherein at least one of the ribs forms a curvilinear raised feature that abuts a trigger guard of the gun disposed in the holster.

13. The holster of claim 1, wherein the gun is receivable in the receptacle space in both a right- and a left-handed orientation and the holster is coupleable to the article in a concealed or open-carry position.

14. A universal holster for handguns comprising:

a front panel and a back panel that each include a first and a second lateral edge, the front and back panels being coupled together along at least a portion of the first and second lateral edges to form a receptacle space between the front and back panels in which a gun is received, each of the panels having a lower end that is bifurcated into a first leg and a second leg, the first legs of the front and back panels being at least partially coupled together along the first lateral edge, and the second legs being at least partially coupled together along the second lateral edge;

a rib disposed on one or both of the front and back panels, the rib providing a laterally extending raised feature on a surface of the respective panel that at least partially protrudes into the receptacle space and one or more of frictionally and mechanically engages the gun; and a pair of laterally spaced-apart clips coupled to the back panel and configured to couple the holster to a user's belt or waistband.

15. The holster of claim 14, wherein the first legs of the front and back panels are flexible independent of the second legs of the front and back panels to enable at least partial conformance of the holster to a user's body in association with a plurality of positions of the user's body.

16. The holster of claim 15, wherein the gun one or more of twists and pivots within the holster to aid conformance of the holster to the user's body.

17. The holster of claim 14, wherein each of the clips comprises a U-shaped body with an inner arm and an outer arm, the inner arm including a first raised feature that extends toward the outer arm and that is at least partially offset from a second raised feature on the outer arm that extends toward the inner arm, the first and second raised features forming a contact surface that lies in a plane that is not parallel to the length of the inner and outer arms.

18. A universal holster for handguns comprising:

a body forming a receptacle space in which a gun is receivable in both a right-handed and a left-handed orientation, the body having a bifurcated lower portion that forms a first leg and a second leg that extend from opposite lateral sides of the body toward a lower end thereof, the first and second legs being independently flexible to aid conformance of the body to a user's body and to a gun received within the body;

a rib disposed interior to the body, the rib providing a laterally extending raised feature on an interior surface of body that at least partially protrudes into the receptacle space and one or more of frictionally and mechanically engages the gun; and a pair of laterally spaced-apart clips coupled to a back side of the body and operable to couple the holster to a user's belt or waistband.

19. The holster of claim 18, wherein the body includes a front panel and a back panel that are biased toward a generally planar orientation and that are flexed outwardly apart to form the receptacle space, the bias on the front panel and the back panel providing a compressive force against the gun when inserted therebetween, the compressive force aiding retention of the gun in the holster.

20. The holster of claim 18, wherein the body includes an upper tab extending from an upper end thereof, the upper tab at least partially obstructing contact with a portion of a butt end of a gun that is received in the receptacle space.

* * * * *